US008371450B2

(12) United States Patent
McGregor et al.

(10) Patent No.: US 8,371,450 B2
(45) Date of Patent: Feb. 12, 2013

(54) SCREENING MODULE

(75) Inventors: Ronald Keith McGregor, Newcastle (AU); Ronald Leslie Johnson, Warners Bay (AU)

(73) Assignee: Ludowici Australia Pty Ltd, Pinkenba, QLD (AU)

( * ) Notice: Subject to any disclaimer, the term of this patent is extended or adjusted under 35 U.S.C. 154(b) by 133 days.

(21) Appl. No.: 12/940,757

(22) Filed: Nov. 5, 2010

(65) Prior Publication Data

US 2011/0049019 A1 Mar. 3, 2011

Related U.S. Application Data

(63) Continuation of application No. 11/911,086, filed as application No. PCT/AU2006/000526 on Apr. 19, 2006, now Pat. No. 8,028,840.

(30) Foreign Application Priority Data

Apr. 20, 2005 (AU) ..... 2005902000

(51) Int. Cl.
*B07B 1/49* (2006.01)

(52) U.S. Cl. ..... 209/405; 209/399; 209/408

(58) Field of Classification Search ..... 209/319, 209/399, 408
See application file for complete search history.

(56) References Cited

U.S. PATENT DOCUMENTS

| | | | | |
|---|---|---|---|---|
| 4,892,767 | A * | 1/1990 | Freissle | 428/52 |
| 5,385,241 | A * | 1/1995 | Bokor | 209/399 |
| 6,253,926 | B1 * | 7/2001 | Woodgate | 209/399 |
| 6,325,216 | B1 * | 12/2001 | Seyffert et al. | 209/408 |
| 6,892,889 | B2 * | 5/2005 | Hukki et al. | 209/405 |
| 7,478,728 | B2 * | 1/2009 | Fisher et al. | 209/399 |
| 7,654,395 | B2 | 2/2010 | Johnson et al. | |
| 2006/0163121 | A1 | 7/2006 | Fisher et al. | |
| 2008/0035533 | A1 | 2/2008 | Johnson et al. | |
| 2008/0135463 | A1 | 6/2008 | Scott et al. | |

FOREIGN PATENT DOCUMENTS

| | | | |
|---|---|---|---|
| AU | 9721898 | A | 3/1999 |
| AU | 8424798 | A | 5/1999 |
| AU | 731011 | | 3/2001 |
| AU | 784455 | | 4/2006 |
| WO | 0141944 | A1 | 6/2001 |
| WO | 2004048007 | A1 | 6/2004 |
| WO | 2005051554 | A1 | 6/2005 |
| WO | WO 2005051554 | A1 * | 6/2005 |
| WO | 2006034526 | A1 | 4/2006 |

OTHER PUBLICATIONS

International Search Report mail date of May 31, 2006 received for corresponding PCT patent application No. PCT/AU2006/000526.
Office Action mailed Jul. 14, 2010 for corresponding U.S. Appl. No. 11/911,068.

* cited by examiner

*Primary Examiner* — Terrell Matthews
(74) *Attorney, Agent, or Firm* — Wong, Cabello, Lutsch, Rutherford & Brucculeri, L.L.P.

(57) ABSTRACT

A screening module for a screening assembly includes a panel member defining a plurality of screening apertures; and a support arrangement with which the panel member is fast. The support arrangement includes a plurality of strengthening arrays arranged, in use, beneath the panel member, each strengthening array comprising a skirt portion bounding an area on a bottom surface of the panel member.

18 Claims, 7 Drawing Sheets

SCREENING MODULE

CROSS-REFERENCE TO RELATED APPLICATIONS

This application is a continuation application of application Ser. No. 11/911,086, filed on Apr. 16, 2008, which nationalized from PCT/AU2006/000526, filed on Apr. 19, 2006, which claims priority from Australian Provisional Patent Application No 2005902000, filed on Apr. 20, 2005, the contents of each of these applications are incorporated herein by reference.

FIELD OF THE INVENTION

This invention relates to the screening of materials. More particularly, the invention relates to a screening module for use in a screening assembly which screens material to classify or sort the material and to a screening assembly including the screening module.

BACKGROUND TO THE INVENTION

Screening arrangements are widely used in the mining industry, particularly the coal mining industry, for the screening or classifying of ores and slurries. Material to be screened is passed over a vibratory screen deck. Apertures of screening panels arranged on the screen deck pass material having dimensions smaller than the apertures of the screen panels while materials having dimensions larger than those of the screening apertures are retained on a top surface of, and traverse, the panels of the screen deck for further processing.

Particularly with very fine apertures, the rigidity of the screening panel must be retained so that the apertures do not distort and pass materials larger than the aperture size. However, with these fine apertures, there is a danger of the apertures becoming blocked or blinding so that material which should pass through the apertures instead traverses the screen deck.

There is therefore a compromise between the need for a rigid panel and the need to inhibit blinding of the apertures.

SUMMARY OF THE INVENTION

According to a first aspect of the invention, there is provided a screening module for a screening assembly, the screening module including:

a panel member defining a plurality of screening apertures; and a support arrangement with which the panel member is fast, the support arrangement including a plurality of strengthening arrays arranged, in use, beneath the panel member, each strengthening array comprising a skirt portion bounding an area on a bottom surface of the panel member.

The skirt portions may be arranged such that channels are defined between adjacent parts of skirt portions of adjacent strengthening arrays. Each channel may be dimensioned to be a sliding fit over a support member of an underlying frame. Thus, each channel may permit vertical displacement of the panel member relative to the underlying support members with a permitted degree of damped, or controlled, sliding movement between the skirt portions and the support members. This assists in dislodging of material blocking or blinding the apertures of the panel member due to the panel member impacting against the support members. Instead, where greater rigidity of the module is desired, the panel member may clip on to the support members of the underlying frame.

In this case, the panel member itself may be made of a more flexible material to aid in inhibiting blocking or blinding of the apertures.

The panel member may be bonded to the support arrangement. More particularly, the panel member may be bonded to the support arrangement by being moulded in a first moulding process with the support arrangement being moulded separately and then being adhesively bonded to an operatively lower surface of the panel member. Instead, the panel member may be fast with the support arrangement by being moulded or cast with the support arrangement as a one-piece unit.

The module may be substantially rectangular when viewed in plan with a mounting formation being arranged along each of at least certain of the sides of the screening module. Preferably, each side carries a mounting formation. Each mounting formation may be in the form of a clip for securing to an underlying rail formation.

The apertures of the panel member may flare outwardly from an operatively top surface of the panel member to an operatively bottom surface of the panel member.

Each strengthening array may include a reinforcing arrangement, the reinforcing arrangement being bounded by the skirt portion. The area bounded by each skirt portion of each strengthening array may be substantially rectangular. Each reinforcing arrangement may include a plurality of reinforcing ribs extending from one side of the skirt portion to an opposed side of the skirt portion.

Preferably, the panel member is fast with an upper surface of each of the ribs as well as with the skirt portion of each reinforcing arrangement.

Each reinforcing arrangement may be without steel reinforcing. Instead, in certain circumstances, reinforcing, such as round steel bar, may be at least partially embedded in the mounting formations to control shrinkage of the support arrangement.

According to a second aspect of the invention, there is provided a screening assembly which includes:

a screening module, as described above; and a support frame for supporting the screening module.

The support frame may be dimensioned to underlie the screening module, the support frame having an outer periphery which corresponds to that of the screening module.

The support frame may include a pair of parallel side members arranged in spaced relationship, the side members being retained in spaced relationship by transversely extending support members. The support members may underlie the panel member of the associated screening module with the support members being received in the channels defined between adjacent skirt portions of the screening module.

Each side member may carry a rail which cooperates with a mounting formation of the screening module extending along one of the longer sides of the screening module.

The support frame may be clipped to underlying rails of a screen deck. Instead, the frame may be secured to the screen deck by means of locating pins. Conveniently, these locating pins may be as described in the Applicant's co-pending International Patent Application No. PCT/AU2005/001376 entitled "A screening module retaining member" filed 9 Sep. 2005. The contents of that international patent application are incorporated in this specification by reference.

DETAILED DESCRIPTION OF EXEMPLARY EMBODIMENTS

Figure 1:
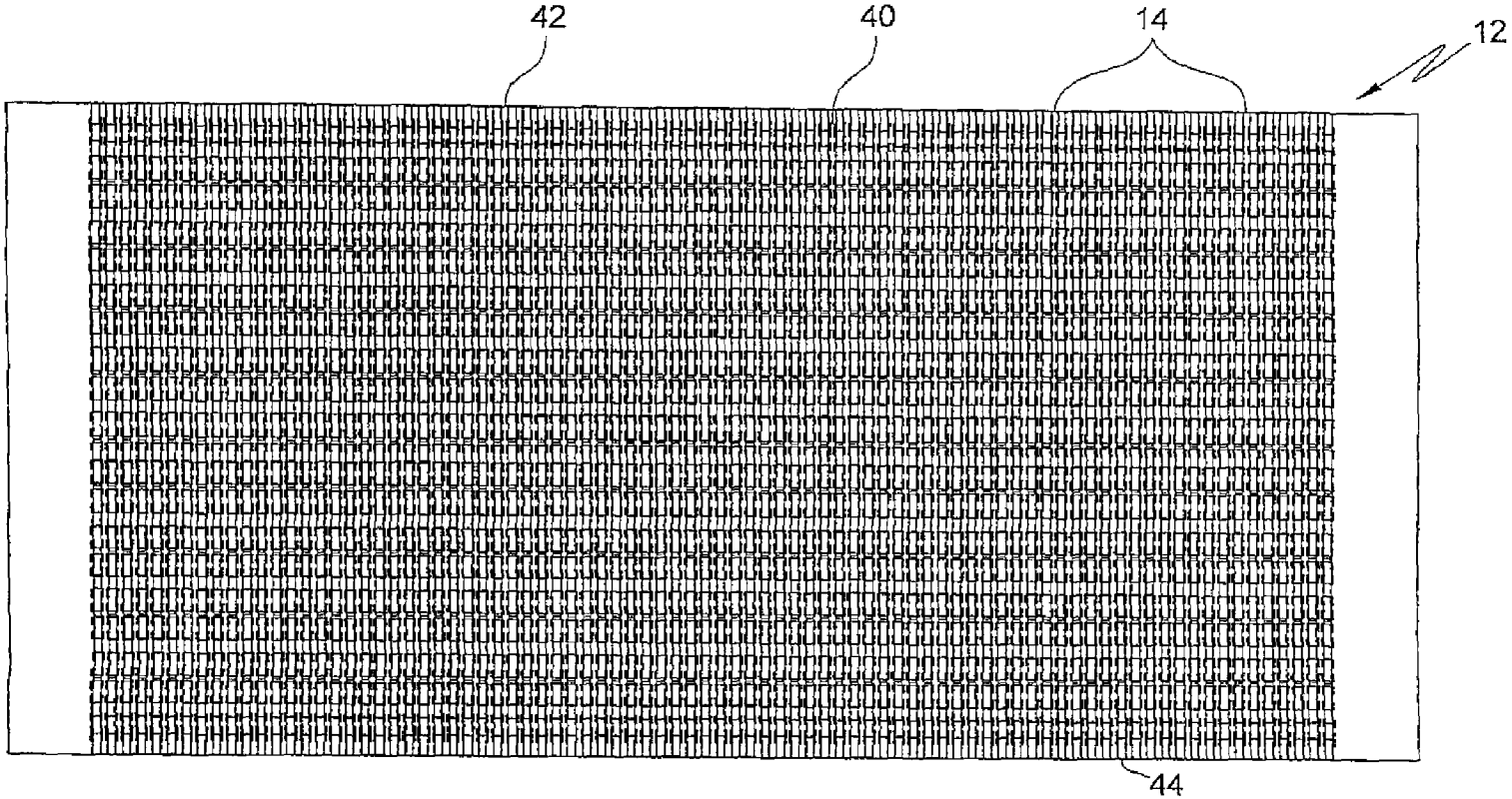
FIG. 1 shows a plan view of a panel member of a screening module in accordance with an embodiment of the invention.
Figure 2:
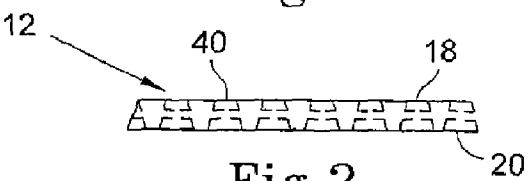
FIG. 2 shows a side view of part of the panel member of FIG. 1 on an enlarged scale.

In the drawings, reference numeral 10 generally designates a screening module in accordance with an embodiment of the invention.

The screening module 10 includes a panel member 12 defining a plurality of screening apertures 14. The panel member 12 is fast with an underlying support arrangement 16.

The support arrangement 16 includes a plurality of strengthening arrays 22. Each strengthening array 22 includes a skirt portion 24 bounding a predetermined area 26 on a bottom surface 20 of its associated panel member 12.

Figure 4:
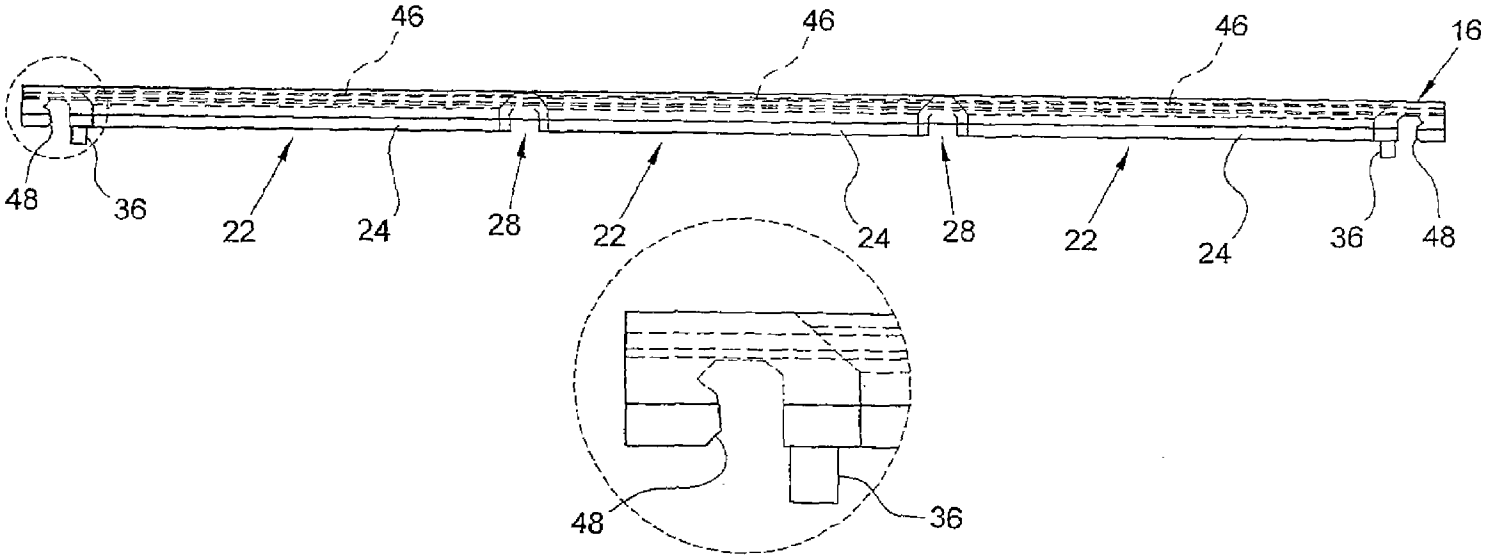
FIG. 4 shows a side view of the support arrangement.

As shown more clearly in FIG. 4 of the drawings, adjacent parts of adjacent skirt portions define channels 28 between them. These channels 28, in use, slidably receive support members 30 (see, for example, FIG. 6) of a support frame 32 of a screening assembly 34, as will be described in greater detail below. Each channel 28 has a width dimension such that the support member 30 is a snug fit in the channel 28. With this arrangement, vertical displacement of the panel member 12 relative to the support members 30 can occur resulting in the support members 30 coming into contact with the bottom surface 20 of the panel member 12 to assist in dislodging material in the apertures 14 which may be blocking or blinding the apertures 14.

In certain circumstances, it may be desirable to have a more rigid module 10. In that case, upper parts of the support members 30 of the support frame 32 may have clip formations which engage corresponding clips (not shown) projecting downwardly from the bottom surface 20 of the panel member 12. These clips may be at spaced intervals in the channels 28 so that the panel member 12 clips to the support members 30 of the support frame 32.

In this embodiment, to inhibit blinding or blocking of the apertures 14 of the panel member 12, the panel member 12 may be made of a more flexible material so that flexing of the panel member 12 inhibits blinding or blocking of the apertures 14.

The support arrangement 16 includes downwardly depending members 36 along shorter sides of the module 10. These downwardly depending members 36, in use, bear against sides of rails 50 (FIG. 6) mounted on a frame 38 of an underlying screen deck on which the screening assembly 34 is mounted. The downwardly depending members 36 serve to inhibit excessive flexing of the panel member 12 of the screening module 10. It will be appreciated that an undesirable degree of flexing could cause the apertures 14 to distort allowing material through the apertures 14 which otherwise would not pass through the apertures 14.

In the illustrated embodiment, the panel member 12 defines apertures 14 in the form of continuous slots 40. By "continuous" means that the slots 40 extend from one long edge 42 of the panel member 12 to an opposed long edge 44 in a substantially uninterrupted fashion.

Each of the slots 40 flares from an operatively top surface 18 of the panel member 12 to the bottom surface 20.

Figure 3:
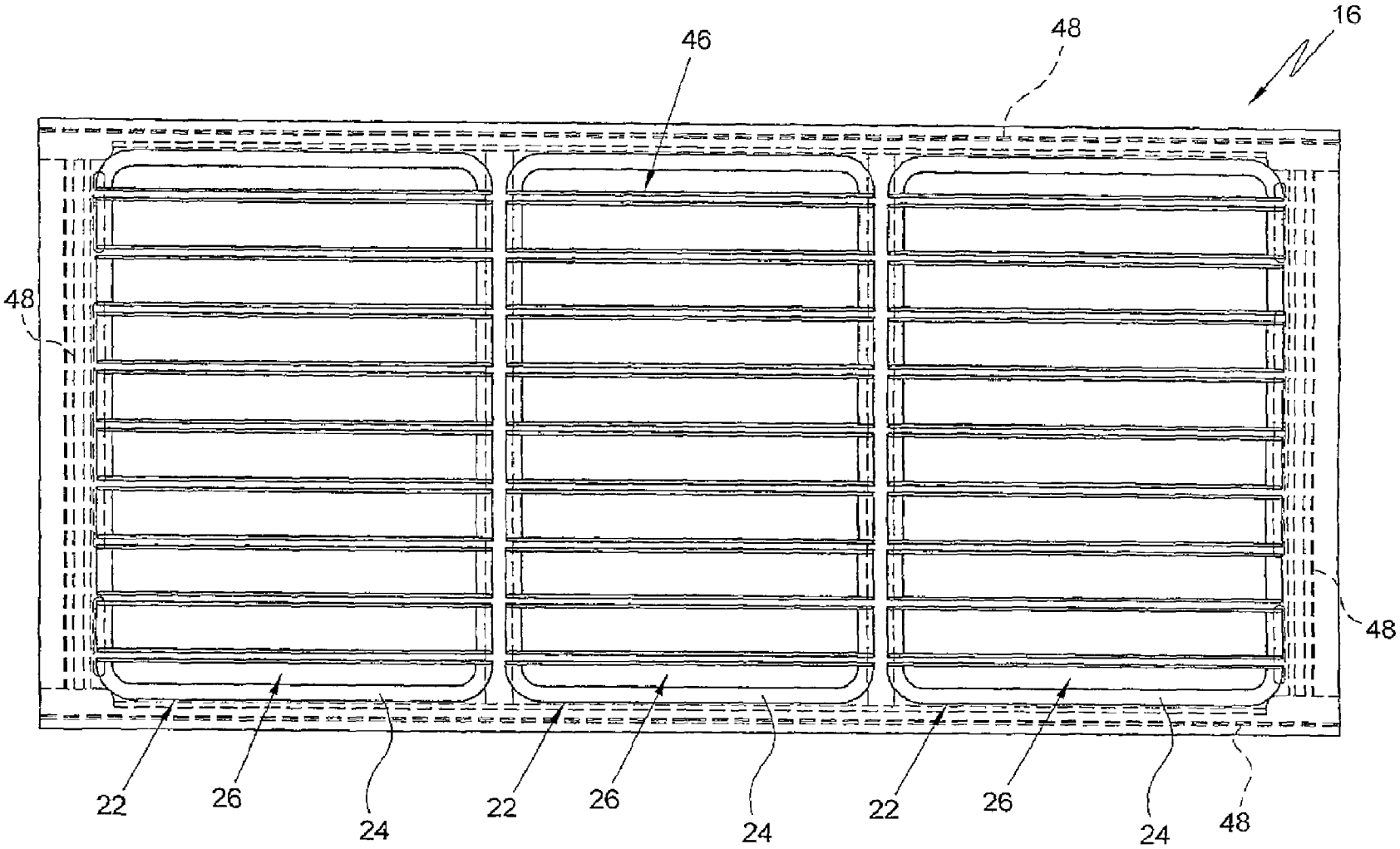
FIG. 3 shows a plan view of a support arrangement of the screening module, the supporting arrangement being used with the panel member of FIG. 1.
Figure 5:
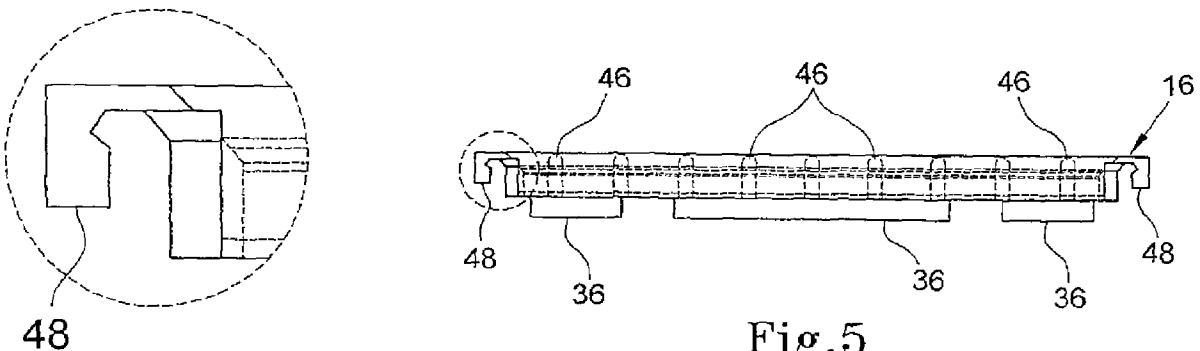
FIG. 5 shows an end view of the support arrangement.

A support arrangement 16 for use with the panel member 12 of FIG. 1 is shown in FIGS. 3-5 of the drawings.

The panel member 12 is fast with the support arrangement 16. More particularly, the panel member 12 is adhesively bonded to the support arrangement 16. Thus, the panel member 12 and the support arrangement 16 are moulded in two separate moulding operations and are then adhesively bonded together.

Instead of the panel member 12 being adhesively bonded to the support arrangement 16, the panel member 12 and the support arrangement 16 may be moulded or cast as a one piece unit so that the panel member 12 is formed fast with the support arrangement 16. For example, the panel member 12 and the support arrangement may be injection moulded as a one-piece unit.

Each area 26 bounded by a skirt portion 24 includes a reinforcing arrangement in the form of a plurality of spaced, parallel ribs 46. In respect of each strengthening array 22, the ribs 46 extend from a part of the skirt portion 24 on one side of the array 22 to a corresponding part of the skirt portion 24 on an opposed side of the array 22. The ribs 46 extend at substantially right angles to the direction of the slots 40 of the panel member 12. The panel member 12 is bonded to the support arrangement 16, for example, by being adhesively bonded to the skirt portions 24 and the ribs 46 of the strengthening arrays 22 of the support arrangement 16. The ribs 46 assist in reinforcing the panel member 12 and inhibit excessive flexing of the slots 40 of the panel member 12.

The support arrangement 16 includes mounting formations in the form of clips 48 for clipping the screening module 10 to the underlying support frame 32 and/or the rails 50 on the frame 38 of the screen deck.

Figure 6:
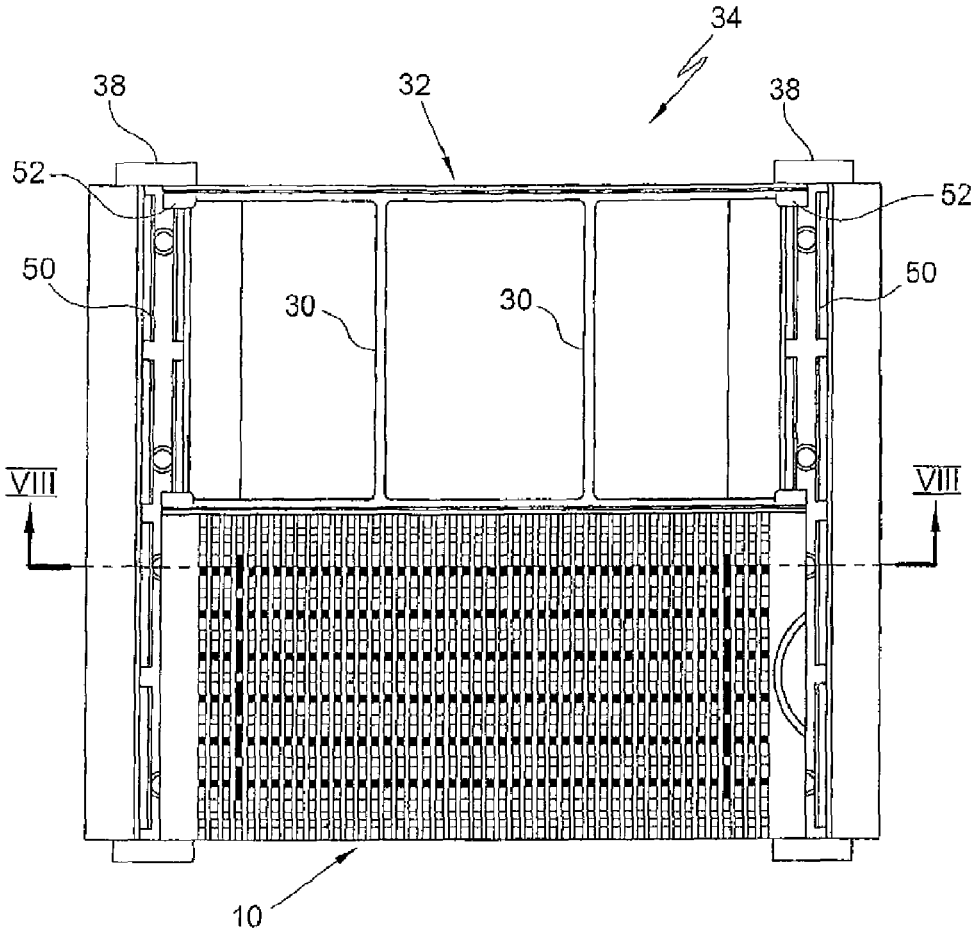
FIG. 6 shows a plan view of a part of one embodiment of a screening assembly.
Figure 7:
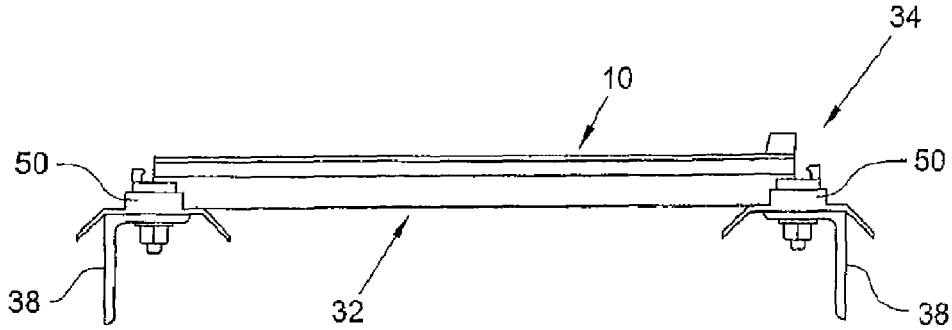
FIG. 7 shows an end view of the part of the screening assembly of FIG. 6.
Figure 8:
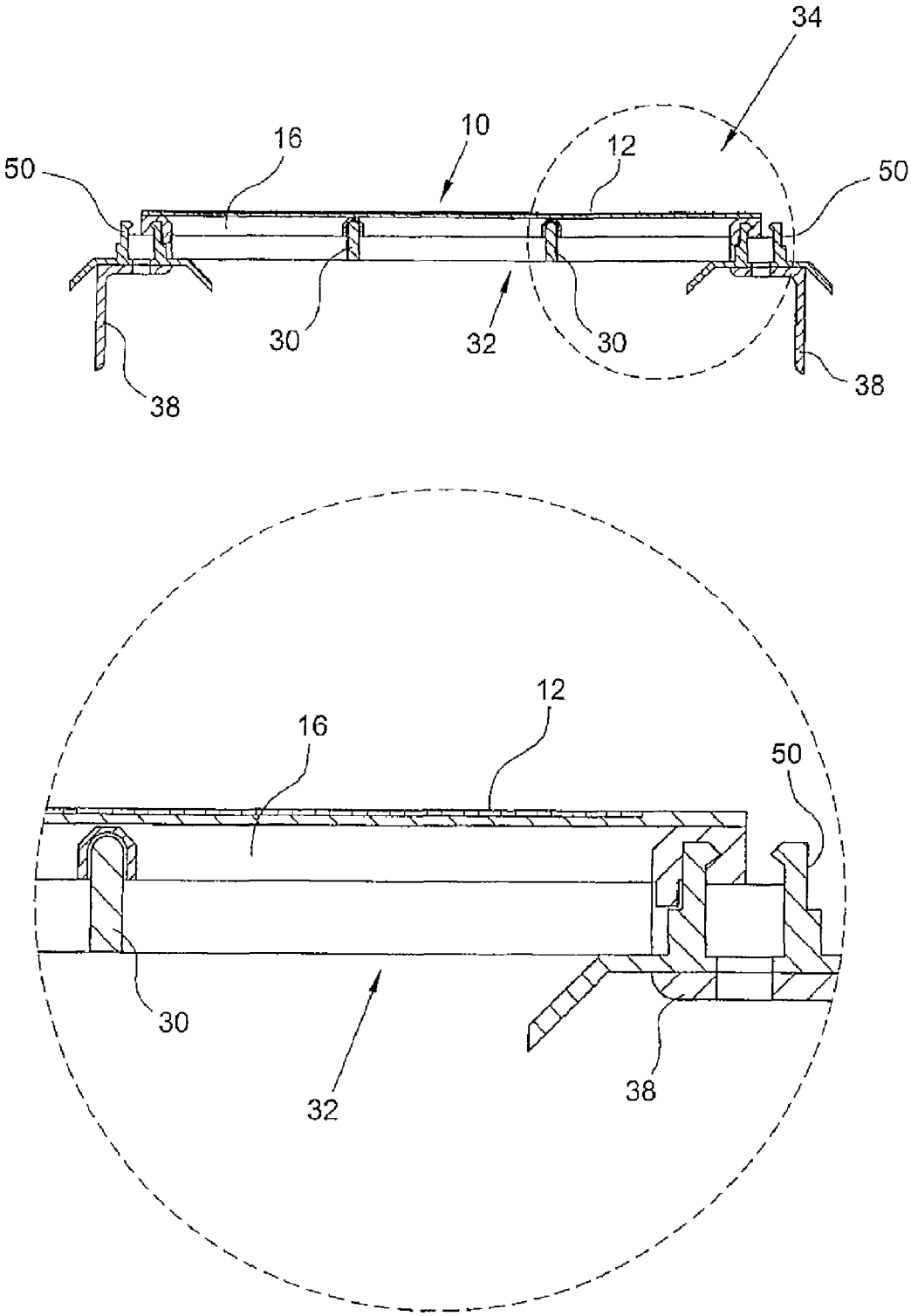
FIG. 8 shows a sectional end view of the part of the screening assembly of FIG. 6 taken along line VIII-VIII in FIG. 6.

In FIGS. 6 to 8 of the drawings, part of a screening assembly 34 in accordance with another embodiment of the invention is shown. In the part illustrated, a complete screening module 10 mounted in position on the screen deck is shown adjacent an underlying support frame 32. It will be appreciated that a further screening module 10 of substantially the same configuration as the illustrated screening module 10 clips on to the exposed frame 32. As shown most clearly in FIG. 8 of the drawings, the support members 30 are received in the channels 28 of the support arrangement 16 of the screening module 10. As the screening module 10 vibrates, the panel member 12 can reciprocate vertically with respect to the support members 30 causing high impact forces to be imparted to the panel member 12 to assist in dislodging any material that my be blocking the slots 40 of the panel member 12.

Figure 9:
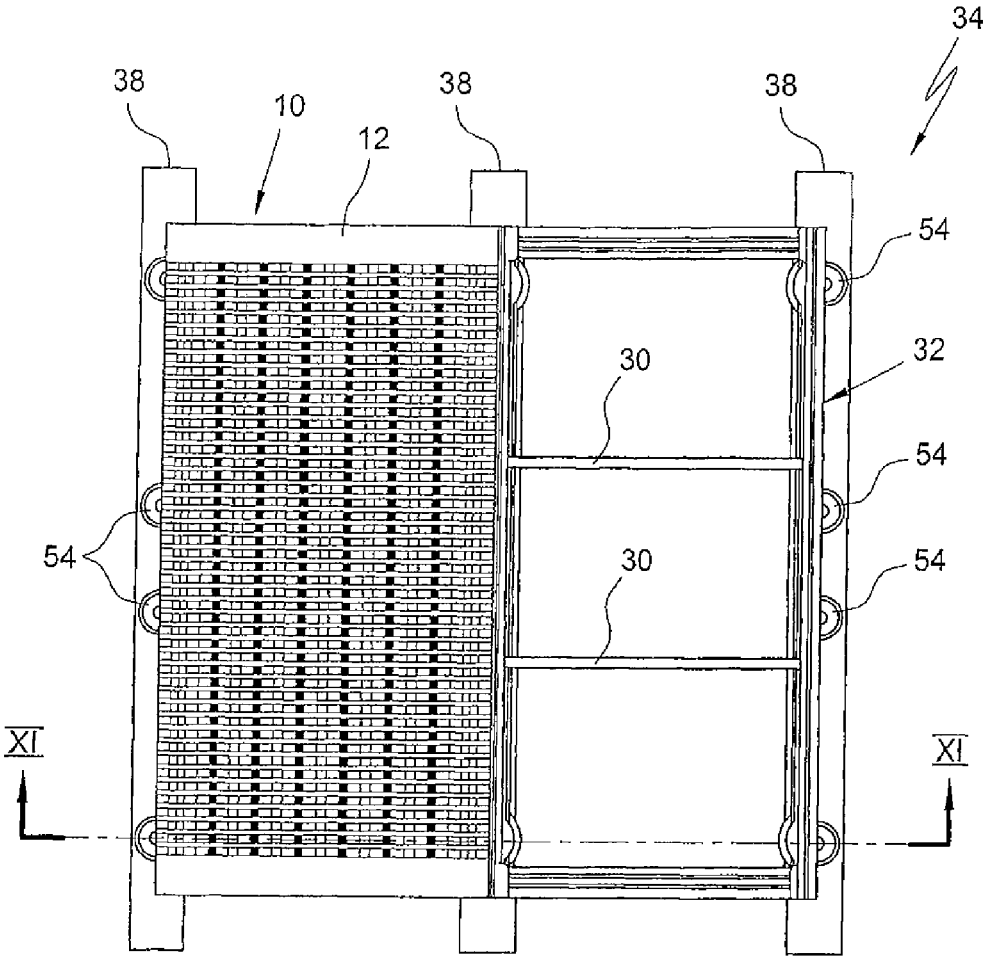
FIG. 9 shows a plan view of another embodiment of a part of a screening assembly.
Figure 10:
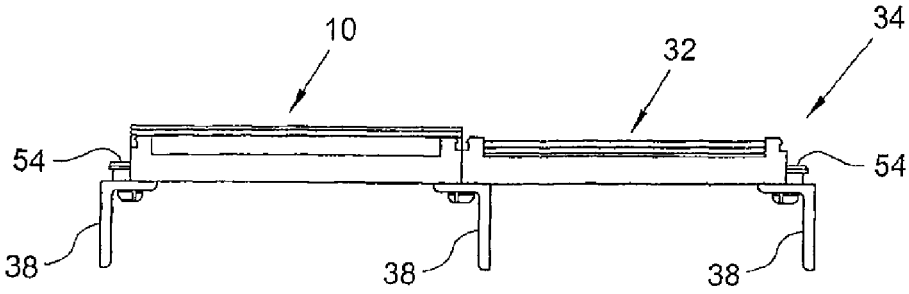
FIG. 10 shows an end view of the part of the screening assembly of FIG. 9.
Figure 11:
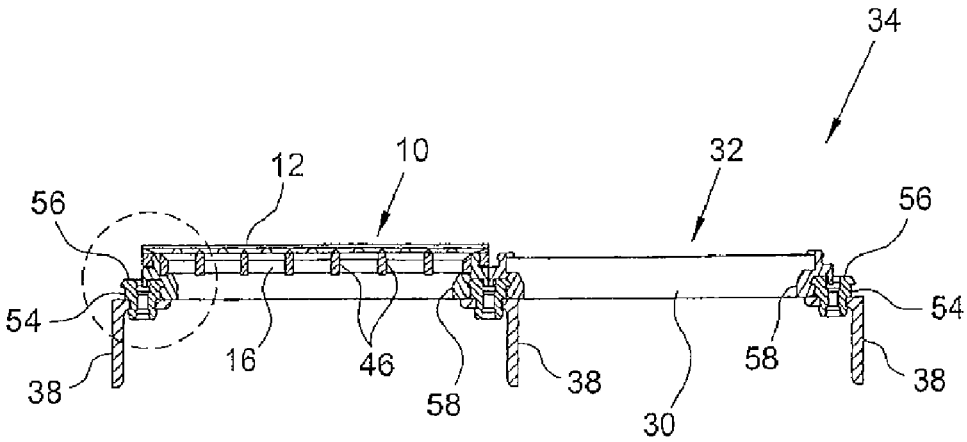
FIG. 11 shows a sectional end view of the part of the screening assembly of FIG. 9 taken along line XI-XI in FIG. 9.
Figure 11:
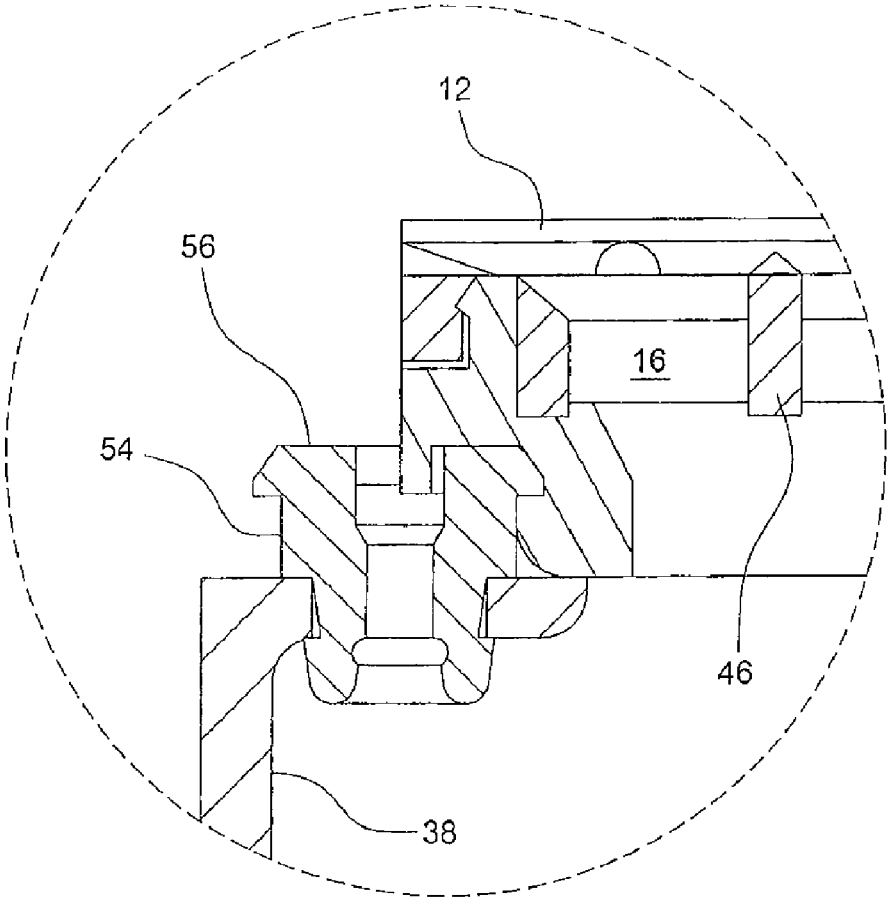

In the embodiment illustrated in FIGS. 6 to 8, the screening module 10 is arranged with the slots 40 extending parallel to the direction of flow of material. In the embodiments illustrated in FIGS. 9 to 11, a so-called cross flow arrangement is illustrated with the slot 40 or apertures 14, respectively, being transverse to the direction of flow of material over the screen deck.

In the embodiment illustrated in FIGS. 6 to 8 of the drawings, the support frame 32 has end elements 52 which clip on to the receiving formations or rails 50 attached to the frame 38 of the screen deck. In yet a further embodiment, the cross flow version being illustrated in FIGS. 8 to 11 of the drawings, the support frame 32 is mounted on the rail 38 by locating pins 54. Each pin 54 has a head 56 received in a part 58 of the support frame 32 as described in the Applicant's co-pending International Patent Application No. PCT/AU2005/001376 referenced above. Thus, the locating pins 54 serve to convert a pin-type screen deck into a rail-type screen deck.

Typically the module 10 excludes any form of steel reinforcing and, as such, is made of a hard synthetic plastics material, more particularly a polyurethane. The polyurethane for the screening module 10 has a Shore Hardness of 93 A to 95 A. If desired, steel reinforcing bars may be included at least in the support arrangement 16 mainly to control shrinkage when the support arrangement 16 is moulded.

It is therefore an advantage of the invention that a screening module 10 is provided that has sufficient flexibility to inhibit blinding of the apertures 14 but still has the requisite degree of strength so that undesired distortion of the apertures 14 is inhibited.

A further advantage of the invention is that the screening module 10 is not secured to the support members 30 of the underlying support frame 32 allowing relative movement between the panel member 12 of the screening module 10 and the support member 30 to assist in dislodging material and clearing blocked or blinded apertures 14.

It is yet a further advantage of the invention that the need for steel reinforcement, which adds to manufacturing costs, is obviated due to the use of the support arrangement 16.

Still further, it is an advantage of the invention that the screening module 10 can be removed from the underlying support frame 32 when the screening module 10 requires replacement. As the support frame 32 can be used for longer periods of time than the screening module 10, the operating costs of the screen deck are considerably reduced as only the screening module 10 requires regular replacement without the need also to replace the underlying support frame. It is a relatively simple procedure to secure the screening module 10 to the underlying support frame 32 and, similarly, to remove the screening module 10 from the support frame 32 when the screening module 10 requires replacement.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A screening module for a screening assembly, the screening module including:

a panel member defining a plurality of screening apertures; and a support arrangement with which the panel member is fast, the support arrangement including a plurality of strengthening arrays arranged, in use, beneath the panel member, each strengthening array comprising a skirt portion bounding an area on a bottom surface of the panel member; wherein:

clips project downwardly from the bottom surface of the panel member, the clips being at spaced intervals in channels defined between adjacent parts of skirt portions of adjacent strengthening arrays.

2. The module of claim 1 in which the skirt portions are arranged such that channels are defined between adjacent parts of skirt portions of adjacent strengthening arrays.

3. The module of claim 2 in which each channel is dimensioned to be a sliding fit over a support member of an underlying frame.

4. The module of claim 1 in which the panel member is bonded to the support arrangement.

5. The module of claim 4 in which the panel member is bonded to the support arrangement by being moulded in a first moulding process with the support arrangement being moulded separately and then bonded to an operatively lower surface of the panel member.

6. The module of claim 1 in which the panel member is fast with the support arrangement by being moulded or cast with the support arrangement as a one-piece unit.

7. The module of claim 1 which is substantially rectangular when viewed in plan with a mounting formation being arranged along each of at least certain of the sides of the screening module.

8. The module of claim 1 in which the apertures of the panel member flare outwardly from an operatively top surface of the panel member to an operatively bottom surface of the panel member.

9. The module of claim 1 in which each strengthening array includes a reinforcing arrangement, the reinforcing arrangement being bounded by the skirt portion.

10. The module of claim 9 in which each reinforcing arrangement includes a plurality of reinforcing ribs extending from one side of the skirt portion to an opposed side of the skirt portion.

11. The module of claim 10 in which the panel member is fast with an upper surface of each of the ribs as well as with the skirt portion of each reinforcing arrangement.

12. The module of claim 1 in which an area bounded by each skirt portion of each strengthening array is rectangular.

13. The module of claim 2 in which the channels permit vertical displacement of the panel member relative to a support member.

14. A screening assembly which includes:

a screening module, as claimed in claim 1; and a support frame for supporting the screening module.

15. The assembly of claim 14 in which the support frame is dimensioned to underlie the screening module, the support frame having an outer periphery which corresponds to that of the screening module.

16. The assembly of claim 14 in which the support frame includes a pair of parallel side members arranged in spaced relationship, the side members being retained in spaced relationship by transversely extending support members.

17. The assembly of claim 14 in which the support members underlie the panel member of the associated screening module with the support members being received between adjacent skirt portions of the screening module.

18. The assembly of claim 14 in which each side member carries a rail which cooperates with a mounting formation of the screening module extending along one of the longer sides of the screening module.

* * * * *